United States Patent [19]

Routson

[11] 4,013,272

[45] Mar. 22, 1977

[54] INLINE MIXER

[75] Inventor: Willis G. Routson, Walnut Creek, Calif.

[73] Assignee: The United States of America as represented by the Secretary of the Navy, Washington, D.C.

[22] Filed: Feb. 2, 1973

[21] Appl. No.: 329,151

[52] U.S. Cl. ..... 259/4 R

[51] Int. Cl.[2] ..... B01F 5/06

[58] Field of Search ..... 259/2, 4, 18, 36, 60; 138/38; 59/78; 137/1

[56] References Cited

UNITED STATES PATENTS

| | | | |
|---|---|---|---|
| 1,088,357 | 2/1914 | Morse | 259/180 |
| 1,832,271 | 11/1931 | Williams | 59/78 |
| 2,020,943 | 11/1935 | Hallquist | 59/78 |
| 3,574,996 | 4/1971 | Loos | 59/78 |
| 3,775,969 | 12/1973 | Vasterling | 59/78 |

*Primary Examiner*—Robert W. Jenkins

[57] ABSTRACT

An inline mixer is readily prepared by placing a chain within a conduit. The conduit generally forms a minimal surface about the chain. Such mixers are quickly and inexpensively prepared.

2 Claims, 5 Drawing Figures

INLINE MIXER

There are many applications where mixing is desirable as a material flows through a conduit. Such mixing may be to mix two or more materials together or may be for the purpose of heat transfer. Known mixers are broadly of three types. Crimped tube mixers such as are typified in U.S. Pat. Nos. 1,922,838; 2,016,720 and 2,663,321. Other mixers involve the insertion of a baffle or baffles into a tube such as is shown in U.S. Pat. No. 2,852,042. Other inserted baffles provided well defined mixing patterns at low flow rates such as those shown in U.S. Pat. Nos. 3,239,197 and 3,286,992. (The teachings of all of the above mentioned patents are herewith incorporated by reference thereto.) An inline mixer without moving parts is very desirable for many applications. One particularly vexatious application is the mixing of reactive resin components to form a hardenable material which cures quickly. Epoxy resin and polyesters are typical of such hardenable reactive materials. Where hardenable reactive materials are employed great care must be exercised in many cases to prevent curing or hardening of the mixed reactants into a resin which then can only be removed from the mixer with great difficulty, if indeed, from a practical standpoint, it can be removed at all. Some of the insert-type pipeline mixers are relatively expensive and difficult to fabricate, and thus are not suited for throwaway or single use applications, and their complexities and difficulties in fabrication preclude their use in many heat exchange applications.

It would be desirable if there were available an improved pipeline mixing unit which could be easily fabricated.

It would also be desirable if there were available an improved pipeline mixing unit which could be prepared from inexpensive materials.

These benefits and other advantages in accordance with the present invention are achieved in a mixer, the mixer comprising a conduit having an inlet and an outlet, the conduit defining an internal passage having an entrance end and an exit end, the internal passage extending from the entrance and to the exit end the conduit having an internal passage wall, a chain disposed within said passage, the chain comprising a plurality of links, said links and said passage wall defining at least one torturous passage extending through said links.

Further contemplated within the scope of the present invention is a method for the preparation of a mixing conduit, said method comprising providing a conduit having a first end, a second end and a passageway extending between said first and second ends, said conduit having an inner wall defining said passage, disposing a chain within said passage, said chain comprising a plurality of freely interconnected links, and retaining said chain within the passage.

Further features and advantages of the present invention will become more apparent from the following specification taken in connection with the drawing wherein.

Figure 1:
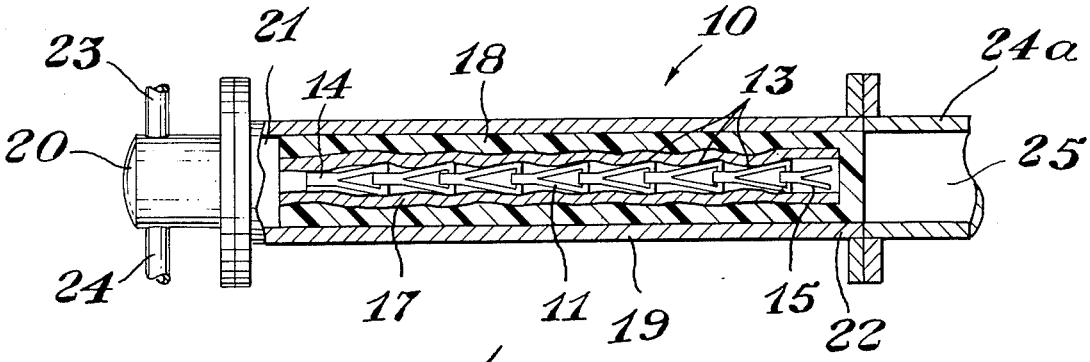
FIG. 1 is a sectional view of mixing apparatus in accordance with the invention.

In FIG. 1 there is depicted a schematic sectional view of apparatus in accordance with the present invention generally designated by the reference numeral 10. The apparatus 10 comprises in cooperative combination a single length of chain 11. The chain 11 comprises a plurality of interconnected links 13. The links 13 as depicted in FIG. 1 are of a flat link sash chain, each link being freely moveable relative to an adjacent link. The chain 11 has a first end 14 and a second end 15. The chain 11 is disposed within and restrained from movement by a conduit 17, the conduit 17 generally diametrically engaging the links 13 of the chain 11, and as depicted in FIG. 1, the conduit 17 defines a generally minimal surface about the chain 11. The conduit 17 is in effect conformed generally to the outer configurations of the chain 11. The conduit 17 is surrounded by a hardened resin matrix 18. The matrix 18 forms a generally annular sleeve about the conduit 17 and maintains the combination of the chain 11 and conduit 17 within an outer housing or conduit 19. The conduit 19 has a first or inlet end 21 and a second or outlet end 22. A fluid source 20 is in operative engagement with the first end 21 of the outer conduit 19. The fluid source 20 has first and second fluid supply means 23 and 24, respectively, each in full communication with the first end 14 of the chain 11. Affixed to the second end 22 of the conduit 19 is a discharge means **24*a* defining an internal passageway 25 which receives material flowing over the chain in the conduit 17.**

In operation of the apparatus 10 of FIG. 1, first and second fluids such as a liquid is supplied to the fluid source 20 from the first and second fluid supply means 23 and 24. Fluid from these supply means then passes over the chain within the conduit 17 following a somewhat indeterminate and torturous path and is removed from the second end 15 in a condition where the fluids have been intermingled to a relatively high degree. The links 13 of the chain 11 within the apparatus 10 are disposed in what may be arbitrarily termed a close arrangement; that is, the links pushed together in a direction corresponding to the longitudinal axis of a linearly arranged chain. This is schematically depicted in FIG. 2.

Figure 2:
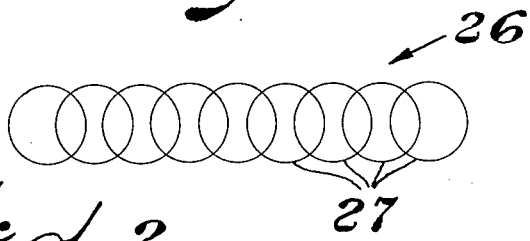
FIG. 2 is a schematic representation of an open link configuration.

In FIG. 2 there is schematically depicted a chain 26 comprising a plurality of links 27 disposed in close arrangement.

Figure 3:
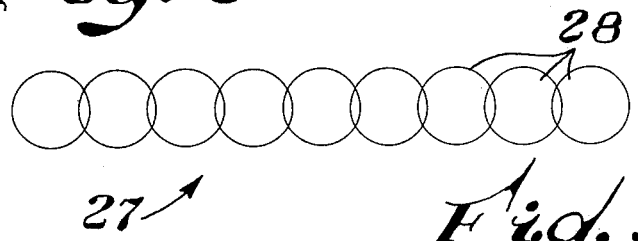
FIG. 3 is a schematic representation of a closed link configuration.

For purposes of comparison, FIG. 3 depicts a chain 28 consisting of a plurality of links 29 in open arrangement.

Figure 4:
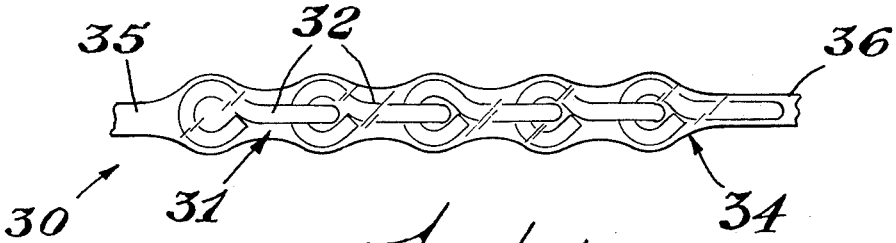
FIGS. 4 and 5 depict alternate embodiments of the present invention.

In FIG. 4 there is schematically depicted a mixer in accordance with the present invention generally designated by the reference numeral 30. The mixer 30 comprises a section of chain 31. The chain so depicted is a single jack chain. The chain 31 comprises a plurality of links 32 in close arrangement. Enclosing the links 32 is a conduit 34 having a first end 35 and a second end 36. As depicted in FIG. 4 the conduit 34 has been shrunk over the chain 31 to provide an enclosure or conduit disposed about the chain which generally conforms to the pattern of a minimal enclosing surface. Operation of the embodiment of FIG. 4 is generally identical to that of FIG. 1.

Figure 5:
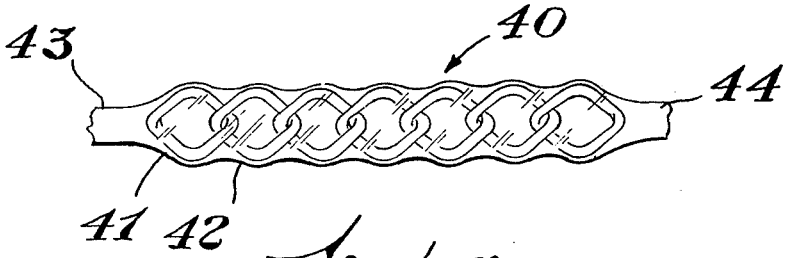

In FIG. 5 there is depicted an alternate embodiment of the invention designated by the reference numeral 40. The mixer 40 comprises a length of chain 41, the chain being of a twist link pattern, the links being in open arrangement and being enclosed within a conduit 42. The conduit 42 is disposed about the chain in such a manner as to provide generally a minimal surface of enclosure. The conduit 42 has a first end 43 and second end 44. The liquid passing into the conduit 42 at the end 43 flows over the chain 42 and follows a torturous path and exits from the end 44 with a greater degree of mixture than on entry into the end 43.

Mixers in accordance with the present invention are prepared from a wide variety of materials, such preparation being accomplished in a relatively economic manner. Chains of almost any pattern may be utilized with benefit in the present invention. The requirements of a chain to be useful are that it be chemically resistant to the material which will flow through the mixer; that it be in either close spaced or open spaced arrangement and surrounded by a minimal enclosing surface; that a continuous path exist along the axis of the chain; and that at least a major portion of the links of the chain be freely moveable relative to its adjacent neighbor. Chains which may be employed may be of welded link constructions; flat link construction; twisted link construction or the links formed by merely butting the end portions to form the links. Such links may be of wire or bar such as depicted in FIG. 3, or flat metal links such as depicted in FIG. 1. Suitable chains for the practice of the present invention include single jack chain; double jack chain; safe or register flat link chain; tensile or Brown chain; single loop lock link or "triumph" chain; flat link sash chain; plumber's chain; safety chain; navy chain; furnace chain; ladder or sprocket chain; universal double joined chains (each link a close wound helix); straight link or twist link, machine, coil or passing link chain.

For small mixers it is particularly beneficial to avoid straight ink, coil chain or passing link chain unless some effort is made to dispose the chain within the conduit in such a manner that alternate links are noncoplanar; such as by twisting the chain before restraining it within the conduit. Particularly beneficial for small mixers; that is, mixers having a diameter up to about ¾ inches, are single jack chain and flat link sash chain. These chains are particularly advantageous when disposed in closed space arrangement within a conduit approximating a minimal enclosing surface.

A wide variety of conduits may be employed in the preparation of mixers in accordance with the present invention. Such conduits may be metal either malleable or cast in place, glass, plastic or the like. One method of preparing conduit in accordance with the present invention is to push the desired length of chain which is a sliding fit for a particular conduit or one which may be forced or drawn therein and the chain maintained in place by deforming the conduit inwardly adjacent to the links to maintain the links in a fixed position such as by forging the conduit about the chain, the width of the chain approximating the width of the conduit. Alternately, the conduit may be deformed inwardly about the chain by the application of hydraulic pressure or the like. One particularly advantageous embodiment employs shrinkable plastic tubing such as oriented polyethylene tubing which has been molecularly oriented in the hoop or circumferentially direction and is readily available commercially under the designation of "shrink tubing." Such tubing when exposed to heat such as hot air decreases in diameter without a large decrease in the length of the tubing. For small mixers such tubing is readily shrunk over a suitable length of chain and may be shrunk over appropriate fittings at the ends. A further alternate manner of preparing mixers in accordance with the present invention is to apply to a chain a hardenable material such as plaster of Paris, form the hardenable material into a generally minimal configuration about the chain such as by wiping with the hand, permitting the material to harden, casting a suitable enclosure about the coated chain and removing the coating by mechanical means or by chemical means from the chain.

By way of further illustration, a mixer is prepared employing a flat link sash chain generally as depicted in FIG. 1 having a link length of about ⅝ inch and a link width of about ⅜ inch and a link height of about 5/16 inch, maximum dimension disposed in close arrangement. The mixer is about 16 inches long. The links are enclosed within a section of polyethylene heat shrink tubing, the tubing shrunk to provide a generally minimal surface about the links and the components of the epoxy resin passed therethrough. Very adequate mixing is obtained as the resin cures to provide desired physical properties.

A second mixer is prepared employing No. 14 jack chain having links about 11/16 inch in length. The jack chain is positioned in a ⅜ inch diameter polyvinylidene fluoride heat shrinkable tube. The chain is in close spaced position and the tubing shrunk about the chain to form a minimal surface. The mixer is then positioned within a one half inch diameter copper tube and the space between the shrunken polyvinylidene fluoride tube and the copper tube filled with an epoxy resin. The mixer is successfully used to mix polyurethane resin components having viscosities of about 25,000 and 10,000 centipoises. Similar beneficial results are achieved when other chains hereinbefore specified are employed.

Beneficially when a metal conduit is employed to contain the chain, excellent heat transfer is obtained between a liquid flowing therein and the conduit. If desired, mixers of the present invention are readily formed in almost any desired configuration, helices and spirals as well as angular arrangements. Usually it is desireable to form the chain and conduit to the desired configuration before deforming the conduit such as by shrinking. In many instances, mixers of the present invention can be prepared inexpensively and can be disposable.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. A mixer, the mixer comprising a conduit having an inlet, a fluid source in operative engagement with the inlet end, an outlet having a discharge means, the conduit defining an internal passage having an entrance end and an exit end, the internal passage extending from the entrance end to the exit end, the conduit having an internal passage wall, the conduit being a shrunken tube, the tube being shrunken about a chain disposed within the passage, the chain comprising a plurality of links, said links and said passage wall defining at least one torturous passage extending through said links and the tube forms a generally minimal surface over the chain.

2. The mixer of claim 1 wherein the conduit is a heat shrunk tube.

* * * * *

UNITED STATES PATENT AND TRADEMARK OFFICE

CERTIFICATE OF CORRECTION

PATENT NO. : 4,013,272

DATED : March 22, 1977

INVENTOR(S) : Willis G. Routson

It is certified that error appears in the above-identified patent and that said Letters Patent are hereby corrected as shown below:

On the Title Page, after Assignee:, delete "The United States of America as represented by the Secretary of the Navy, Washington, D.C." and insert --The Dow Chemical Company, Midland, Mich.--;

Column 1, line 43, after entrance, delete "and" and insert --end--;

Column 2, line 55, delete "so" and insert --as--;

Column 3, line 61, delete "circumferentially" and insert --circumferential--.

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*